United States Patent [19]

Sugita et al.

[11] Patent Number: 5,063,148

[45] Date of Patent: Nov. 5, 1991

[54] SILVER HALIDE LIGHT-SENSITIVE PHOTOGRAPHIC MATERIAL

[75] Inventors: Shuichi Sugita; Noboru Mizukura; Junichi Kohno; Kenzi Kadokura; Atsushi Tomotake, all of Hino, Japan

[73] Assignee: Konica Corporation, Tokyo, Japan

[21] Appl. No.: 503,539

[22] Filed: Apr. 3, 1990

[30] Foreign Application Priority Data

Apr. 7, 1989 [JP] Japan ..... 1-89304

[51] Int. Cl.[5] ..... G03C 7/32

[52] U.S. Cl. ..... 430/551; 430/558

[58] Field of Search ..... 430/551, 558

[56] References Cited

U.S. PATENT DOCUMENTS

| | | | |
|---|---|---|---|
| 4,178,184 | 12/1979 | Taguchi et al. | 430/503 |
| 4,814,262 | 3/1989 | Sugita et al. | 430/551 |
| 4,820,614 | 4/1989 | Takada et al. | 430/505 |
| 4,839,264 | 6/1989 | Kida et al. | 430/505 |
| 4,906,559 | 3/1990 | Nishijima et al. | 430/551 |

FOREIGN PATENT DOCUMENTS

WO86/01915 3/1986 PCT Int'l Appl. .

*Primary Examiner*—Charles L. Bowers, Jr.
*Assistant Examiner*—Janis L. Dote
*Attorney, Agent, or Firm*—Jordan B. Bierman

[57] ABSTRACT

A silver halide light-sensitive photographic material which is capable to form magenta dye image of substantially improved light-fastness and to form non-colored portion free from Y-stain is disclosed. The material comprises compounds represented by general formula M-I and II in the layers separately or together.

General formula M-I

General formula II

36 Claims, No Drawings

SILVER HALIDE LIGHT-SENSITIVE PHOTOGRAPHIC MATERIAL

FIELD OF THE INVENTION

The present invention relates to a silver halide light-sensitive color photographic material, in particular, to a silver halide light-sensitive material that is capable of providing color images stable to heat and light, and not liable to the occurrence of Y-stain.

BACKGROUND OF THE INVENTION

It has been well known that when a silver halide light-sensitive photographic material is exposed image-wise and developed, an oxidation product of aromatic primary amine color developing agent reacts with a coupler to form dyes such as indophenol, indoaniline, indamine, azomethine, phenoxyazine, phenazine and their analogues, thus color images are formed. Usually, in such photographic system, a color reproduction technique based on the subtractive process is used; wherein the light-sensitive silver halide color photographic material used comprises the blue-sensitive, green-sensitive, and red-sensitive silver halide emulsion layers correspondingly containing yellow dye forming, magenta dye forming, and cyan dye forming couplers, i.e. couplers whose sensitivities complementary to the color sensitivities of these emulsion layers.

The couplers useful for forming the yellow dye image include acylacetanilide couplers; and the couplers useful for forming the magenta dye image include pyrazolone, pyrazolobenzimidazole, pyrazolotriazole, and indazolone couplers; while the examples of the commonly used cyan dye image forming couplers include phenol and naphthol couplers.

The so-obtained image is required to be stable even when exposed to light for a long time, or even when stored under a high temperature or high humidity. Moreover, a silver halide color photographic light-sensitive material (hereinafter referred to as color photographic material) which does not cause yellow stain (hereinafter referred to as Y-stain), by heat or moisture, in the non-colored portion has been a long-felt demand in the art.

As compared with yellow dye forming couplers (hereinafter referred to as yellow coupler)and cyan dye forming couplers (hereinafter referred to as cyan coupler), magenta dye forming couplers (hereinafter referred to as magenta coupler) are liable to cause more significant Y-stain by light, moisture, or heat in the non-colored portion, as well as fading in the colored portion caused by light, and this disadvantage often incurs a problem.

The couplers commonly used for forming magenta dye image are 5-pyrazolones. The magenta dyes formed from the 5-pyrazolone magenta couplers have a big problem in having secondary spectral absorption in the vicinity of 430 nm, in addition to the primary spectral absorption in the vicinity of 550 nm. Therefore, various studies have been conducted to solve this problem.

The magenta coupler having an anilino group on the 3 position of 5-pyrazolone, which exhibits less significant secondary absorption, is known to be useful in obtaining color images for print. The related techniques are disclosed, for example, in U.S. Pat. No. 2,343,703 and British Patent No. 1,059,994.

However, these magenta couplers are disadvantageous as they are significantly inferior in the image preservability, especially, in the stability of dye images to light, as well as in larger magnitude of Y-stain in the non-colored portion.

Other means proposed for limiting the above-mentioned secondary absorption of magenta couplers in the vicinity of 430 nm are magenta couplers such as pyrazolobenzimidazole couplers in British Patent No. 1,047,612; indazolone couplers in U.S. Patent No. 3,770,447; 1H-pyrazolo[5,1-c]-1,2,4-triazole couplers in U.S. Pat. No. 3,725,067, British Patent Nos. 1,252,418, and 1,334,515; 1H-pyrazolo[1,5-b]-1,2,4-triazole couplers in Research Disclosure 24531 (1984); 1H-pyrazolo[1,5-c]-1,2,3-triazole couplers in Research Disclosure 24626 (1984); 1H-imidazo[1,2-b]pyrazole couplers in Japanese Patent Publication Open to Public Inspection (hereinafter referred to as Japanese Patent O.P.I. Publication) No. 162548/1984 and Research Disclosure 24531 (aforementioned); 1H-pyrazolo[1,5-b]pyrazole couplers in Research Disclosure 24230 (1984); and 1H-pyrazolo[1,5-d]tetrazole couplers in Research Disclosure 24220 (1984). Among them, the dyes formed from 1H-pyrazolo[5,1-c]-1,2,4-triazole couplers,1H-pyrazolo[1,5-b]-1,2,4-triazole couplers, 1H-pyrazolo[1,5-c]-1,2,3-triazole couplers, 1H-imidazo[1,2-b]pyrazole couplers, 1H-pyrazolo[1,5-b]pyrazole couplers and 1H-pyrazolo[1,5-d]tetrazole couplers are advantageous in terms of color reproduction, as compared with the previously mentioned dyes formed from 5-pyrazolones having an anilino group on the 3 position; in having significantly smaller secondary absorption in the vicinity of 430 nm, and in causing relatively small Y-stain due to light, heat, or moisture, in the non-colored portion.

However, the azomethine dyes formed from these couplers are disadvantageous for their substantially lower light-fastness 'nd liability to discloration, and by this disadvantage, the property of color photographic material, especially that of color photographic material for print is substantially deteriorated.

Incidentally, methods in Japanese Patent O.P.I. Publication Nos. 125732/1984 and 262159/1985 propose, as a means to improve the light-fastness of the magenta dye image formed from pyrazoloazole magenta couplers, to incorporate phenol-type or phenylether-type compounds into pyrazoloazole magenta couplers.

These methods, however, are still insufficient in preventing the magenta dye image fading by light, in addition to the inability to prevent discoloration by light.

SUMMARY OF THE INVENTION

The present invention was accomplished to cope with problems mentioned above. Thus, the first object of the invention is to provide a color photographic material that forms magenta dye image of substantially improved light-fastness and has good color reproducibility.

The second object of the invention is to provide a color photographic material whose magenta dye image is less liable to change color even when exposed to light.

The third object of the invention is to provide a color photographic material free from Y-stain at the non-colored portion under exposure to light.

The objects of the invention mentioned above can be achieved by a silver halide color photographic light-sensitive material comprising a magenta coupler represented by General Formula [M-I]and a compound represented by General Formula [II]:

General Formula [M-I]

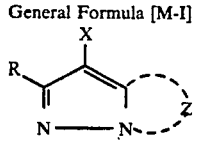

wherein Z is a nonmetallic atomic group necessary for forming a nitrogen-containing heterocyclic ring, wherein the so-formed ring may have a substituent.

X is a hydrogen atom; or a group that is capable of being split off by reaction with an oxidation product of a color developing agent.

R is a hydrogen atom or a substituent.

General Formula [II]

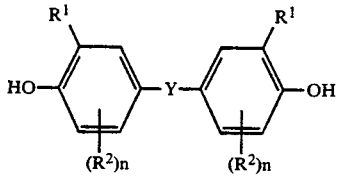

wherein $R^1$ is a secondary or tertiary alkyl, secondary or tertiary alkenyl, cycloalkyl or aryl group. $R^2$is a halogen atom, or an alkyl, alkenyl, cycloalkyl or aryl group. n is an integer of 0 to 3. Y is a S, SO, $SO_2$, or alkylene group.

DETAILED DESCRIPTION OF THE INVENTION

In General Formula [M-I], the substituent represented by R is not particularly limited but is typically an alkyl, aryl, anilino, acylamino, sulfonamide, alkylthio, arylthio, alkenyl, or cycloalkyl group; and other examples include a halogen atom, cycloalkenyl, alkynyl, heterocyclic, sulfonyl, , aryloxy, heterocyclic oxy, siloxy, acyloxy, carbamoyloxy, amino, alkylamino, imide, ureide, sulfamoylamino, alkoxycarbonylamino, aryloxycarbonylamino, alkoxycarbonyl, aryloxycarbonyl, and heterocyclic thio groups, and spiro residue and bridged hydrocarbon residue.

The alkyl group represented by R is preferably any of those having 1 to 32 carbon atoms, and may be straight-chained or branched.

The aryl group represented by R is preferably a phenyl group.

Examples of the acylamino group represented by R include alkylcabonylamino and arylcarbonylamino groups.

Examples of the sulfonamide group represented by R include alkylsulfonylamino and arylsulfonylamino groups.

Examples of the alkyl and aryl components in the alkyl thio and arylthio groups represented by R include the above-mentioned alkyl and aryl groups represented by R.

The alkenyl group represented by R is preferably any of one having 2 to 32 carbon atoms; and cycloalkenyl represented by R is one having 3 to 12, or, preferably, 5 to 7 carbon atoms; the alkenyl group may be straight-chained or branched.

The cycloalkyl represented by R is one having 3 to 12, or, preferably, 5 to 7 carbon atoms.

Examples of the sulfonyl group represented by R include alkylsulfonyl and arylsulfonyl groups.

Examples of the so-represented sulfinyl group include alkylsulfinyl and arylfulfinyl groups.

Examples of the so-represented phosphonyl group represented by R include alkylphosphonyl, alkoxyphosphonyl aryloxyphosphonyl and arylphosphonyl groups.

Examples of the acyl group represented by R include alkylcarbonyl and arylcarbonyl groups.

Examples of the so-represented carbamoyl group include alkylcarbamoyl and arylcarbamoyl groups.

Examples of the so-represented sulfamoyl group include alkylsulfamoyl and arylsulfamoyl groups.

Examples of the so-represented acyloxy group include alkylcarbonyloxy and arylcarbonyloxy groups.

Examples of the so-represented carbamoyloxy include alkylcarbamoyloxy and arylcarbamoyloxy groups.

Examples of the so-represented ureide group include alkylureide and arylureide groups.

Examples of the so-represented sulfamoylamino group include alkylsulfamoylamino and arylsulfamoylamino groups.

The so-represented heterocyclic group is preferably 5- to 7-membered one, and examples of which include 2-furil, 2-thienyl, 2-pyrimidinyl and 2-benzothiazolyl groups.

The so-represented heterocyclic oxy group is preferably 5- to 7-membered one, and examples of which include 3,4,5,6-tetrahydropyranyl-2-oxy and 1-phenylterazole-5-oxy groups.

The so-represented heterocyclic thio group is preferably 5- to 7-membered one, and examples of which include 2-pyridylthio, 2-benzothiazolylthio and 2,4-diphenoxy-1,3,5-triazole-6-thio groups.

Examples of so-represented siloxy group include trimethylsiloxy, triethylsiloxy and dimethylbutylsiloxy groups.

Examples of the so-represented imide group include succinimide, 3-heptadecyl succinimide, phthalimide and glutarimide groups.

Examples of the so-represented spiro residue include spiro[3,3]heptane-1-yl.

Examples of the so-represented bridged hydrocarbon residue include bicyclo[2,2,1]heptane-1-yl, tricyclo[3,3,1,$1^{3,7}$]decane-1-yl and 7,7-dimethyl-bicyclo[2,2,1]heptane-1-yl groups.

Examples of the group that is represented by X include a hydrogen atom, halogen atoms (e.g. chlorine, bromine and fluorine atoms); alkoxy, aryloxy, heterocyclic oxy, acyloxy, sulfonyloxy, alkoxycarbonyloxy, aryloxycarbonyl, alkyloxalyloxy, alkoxyoxalyloxy, alkylthio, arylthio, heterocyclic thio, alkyloxythio carbonylthio, acylamino, sulfonamide, N-atom bonded nitrogen-containing heterocycle, alkyloxycarbonylamino, aryloxycarbonylamino, carboxyl, and

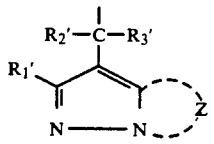

(wherein $R_1'$ is synonymous with the previously defined R, Z' is synonymous with the previously defined Z, $R_2'$ and $R_3'$ independently represent a hydrogen atom, or aryl, alkyl, or heterocyclic group). Among these examples, however, preferable ones are hydrogen atom and halogen atom, in particular, hydrogen atom and chlorine atom.

Examples of the nitrogen-containing heterocycle formed by Z include pyrazole, imidazole, triazol, and terazole rings. For the substituent which any of these rings may have, those mentioned with respect to the previously defined R are available.

Those that are represented by General Formula [M-I] are more specifically represented by the following General Formulas [M-II] through [M-VII]:

General Formula [M-II]

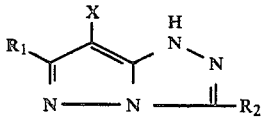

General Formula [M-III]

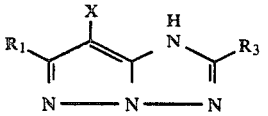

General Formula [M-IV]

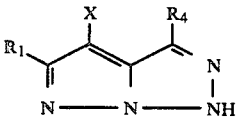

General Formula [M-V]

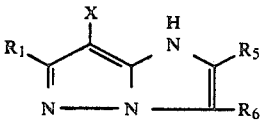

General Formula [M-VI]

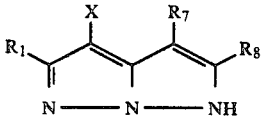

General Formula [M-VII]

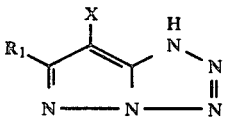

In General Formulas [M-II] through [M-VII], $R_1$ through $R_8$ and X are synonymous with the previously mentioned R and X.

Among those that are represented by General Formula [M-I], particularly preferred ones are those that are represented by the following General Formula [M-VIII]:

General Formula [M-VIII]

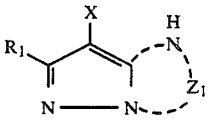

wherein $R_1$, X and $Z_1$ are synonymous with R, X and Z in General Formula [M-I].

Among the magenta couplers expressed by General Formulas [M-II] through [M-VII], the particularly preferred are magenta couplers expressed by General Formula [M-II].

Among the substituents that are positioned on the above heterocycle and represented by R and $R_1$, the most favorable are those expressed by the following General Formula [M-IX]:

General Formula [M-IX]

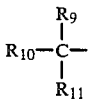

wherein $R_9$, $R_{10}$ and $R_{11}$ are synonymous with R specified above.

Two of the said $R_9$, $R_{10}$ and $R_{11}$, e.g. $R_9$ and $R_{10}$, may bond with each other to form a saturated or unsaturated ring (e.g. cycloalkane, cycloalkene and heterocycle), and further, $R_{11}$ may bond with the so-formed ring to form a bridged hydrocarbon residue.

Among those expressed by General Formula [M-IX], preferred cases are; (i) at least two of $R_9$ through $R_{11}$ are alkyl groups, (ii) one of $R_9$ through $R_{11}$, $R_{11}$ for example, is a hydrogen atom, and $R_9$ and $R_{10}$ bond with each other to form a cycloalkyl in conjunction with the base carbon atom.

Further, in the above case (i), it is particularly favorable that two of $R_9$ through $R_{11}$ are alkyl groups, while the other one is a hydrogen atom or an alkyl group.

The preferable substituent which may be linked with the ring formed by Z of General Formula [M-I] or with the ring formed by $Z_1$ of General Formula [M-VIII], and the $R^2$ through $R^8$ of General Formula [M-II] through [M-VI] are preferably those that are expressed by the following General Formula [M-X]:

General Formula [M-X]

$$-R_{12}-SO_2-R_{13}$$

wherein $R_{12}$ is an alkylene group; and $R_{13}$ is an alkyl, cyclo alkyl or aryl group.

The alkylene group expressed by $R_{12}$ is preferably one that has 2 or more, in particular, 3 to 6 carbon atoms in the straight-chain portion; and may be either straight-chained or branched.

The cycloalkyl group expressed by $R_{13}$ is preferably 5- to 6-membered one.

The typical examples of the compounds according to the invention are as follows.

M-1
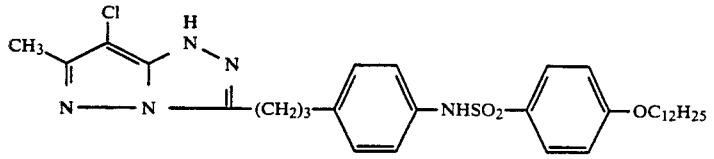
M-2
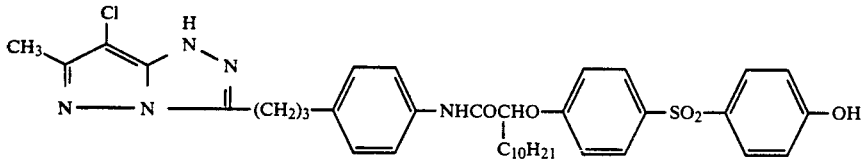
M-3
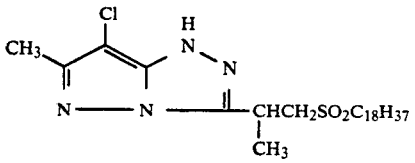
M-4
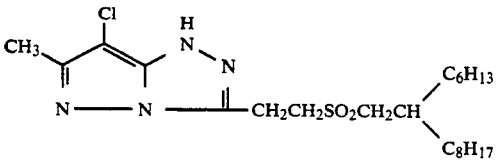
M-5
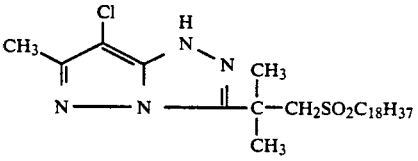
M-6
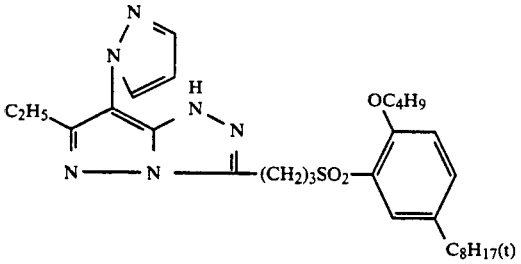
M-7
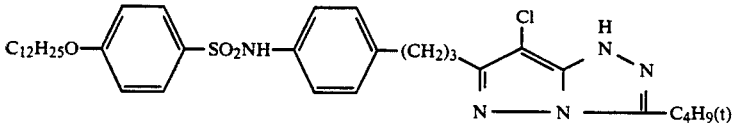
M-8
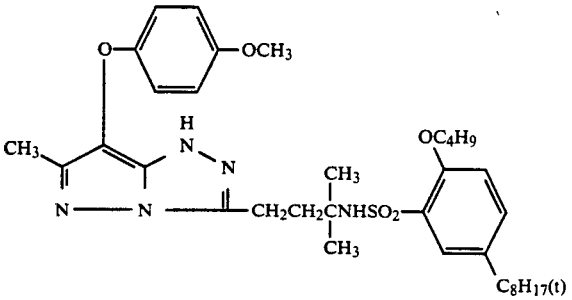

-continued
M-9
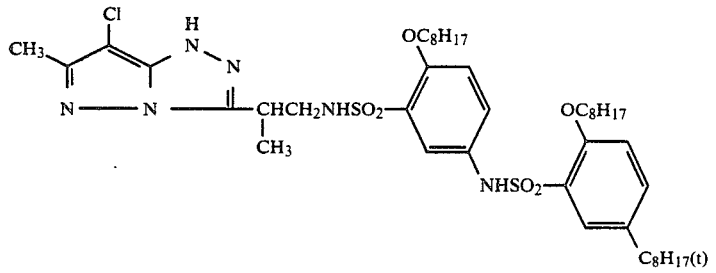
M-10
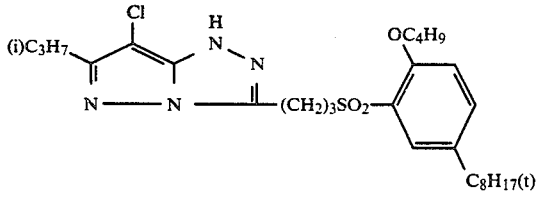
M-11
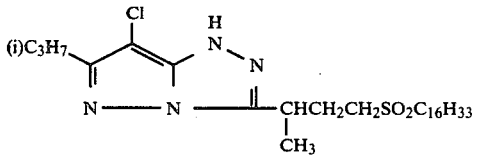
M-12
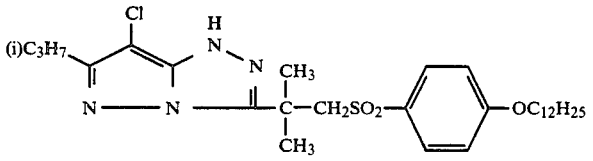
M-13
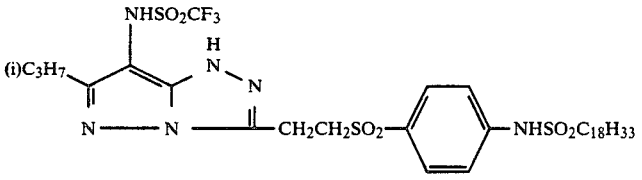
M-14
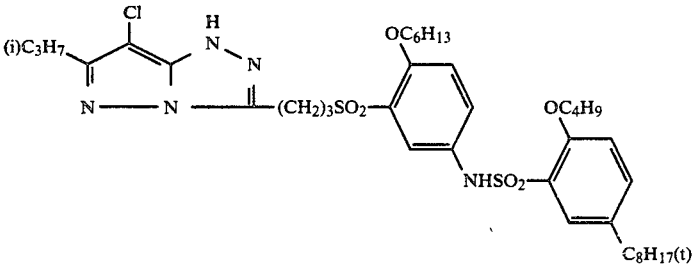
M-15
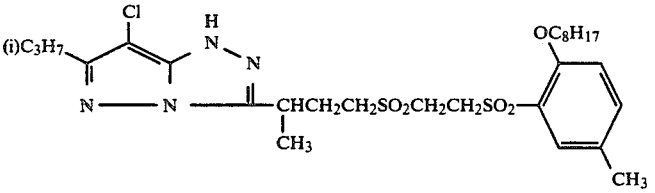

-continued
M-16
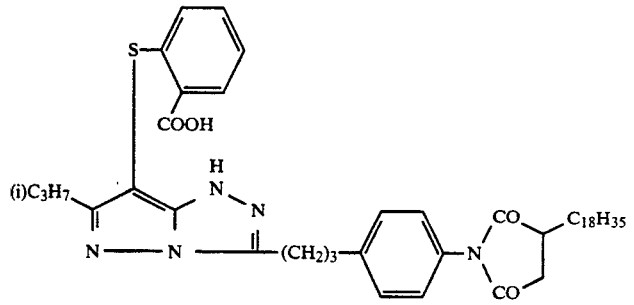
M-17
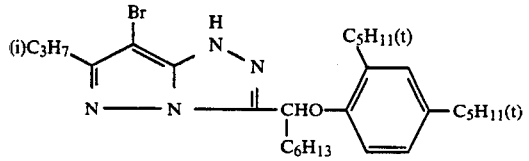
M-18
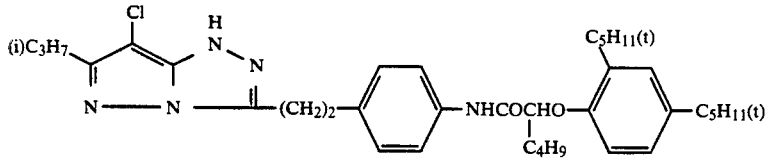
M-19
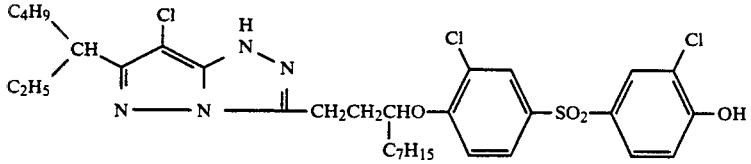
M-20
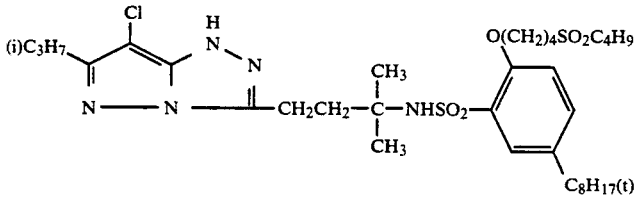
M-21
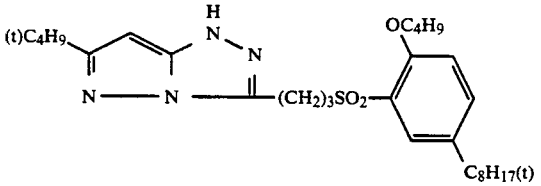
M-22
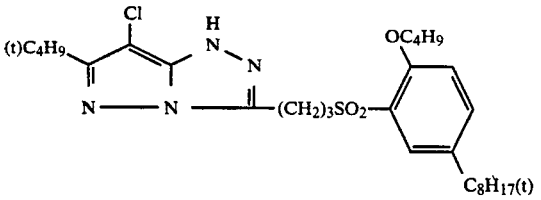
M-23
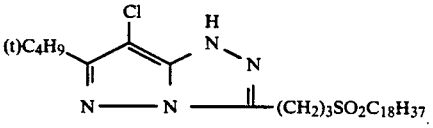
M-24
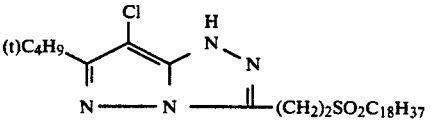

-continued
M-25
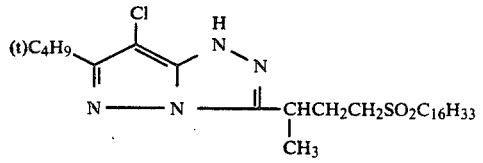
M-26
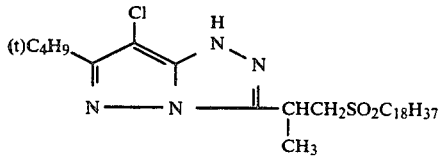
M-27
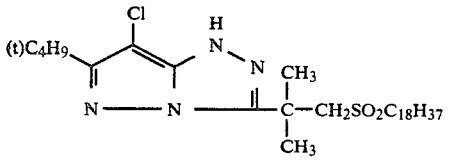
M-28
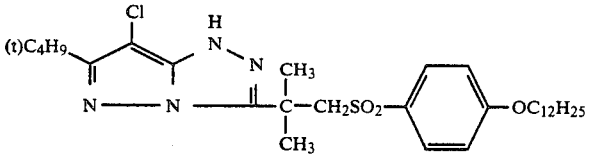
M-29
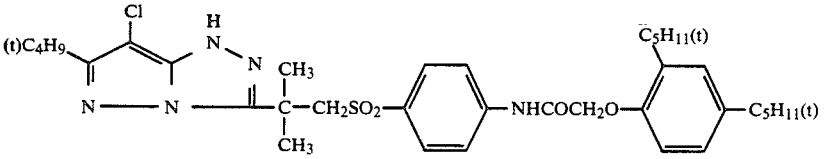
M-30
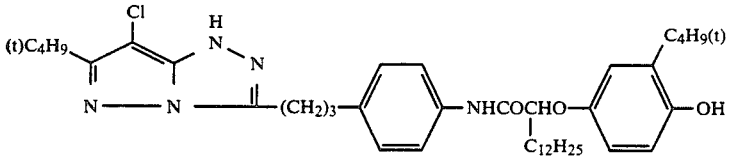
M-31
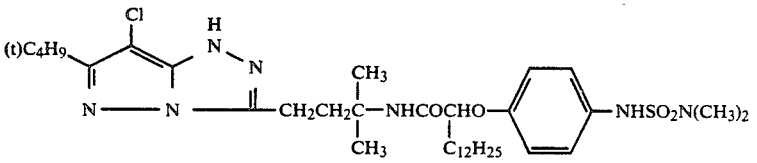
M-32
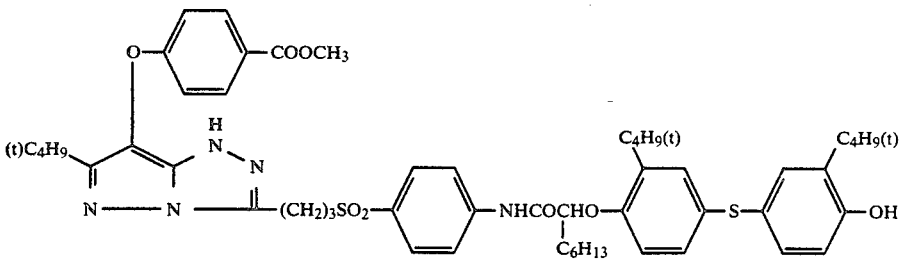

-continued
M-33
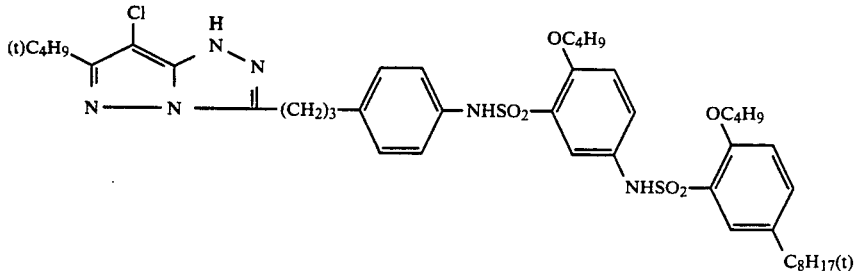
M-34
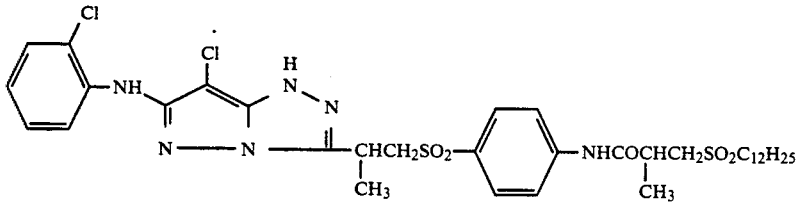
M-35
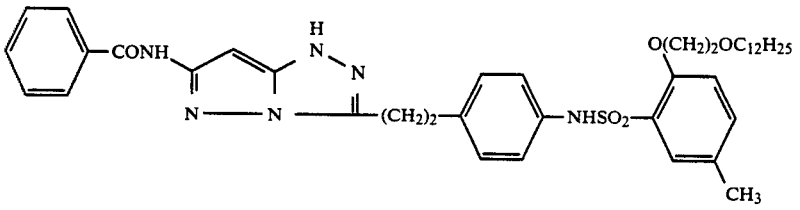
M-36
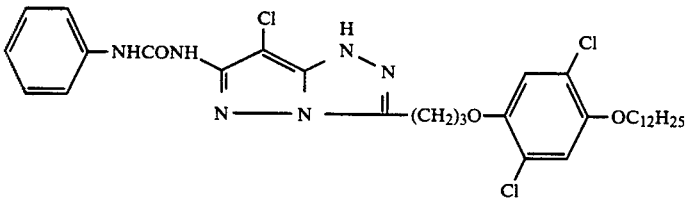
M-37
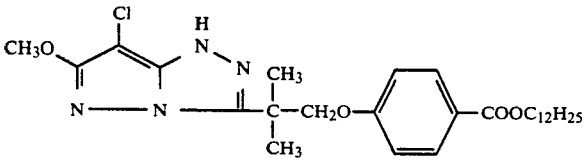
M-38
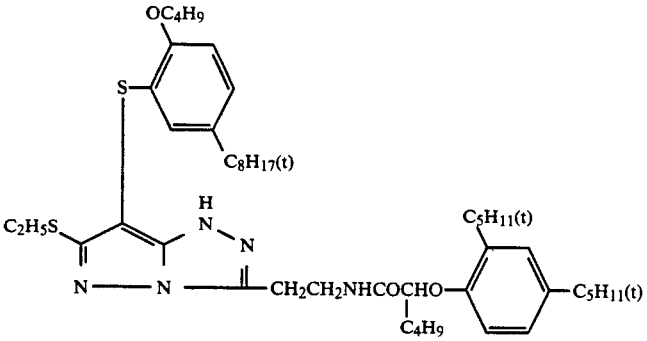
M-39
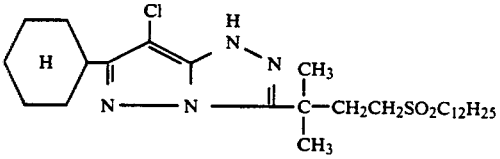

-continued
M-40
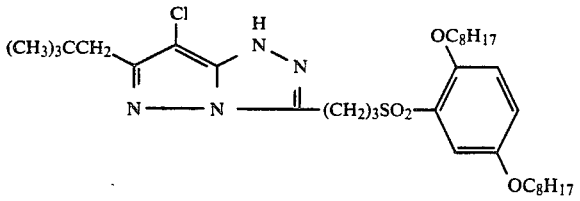
M-41
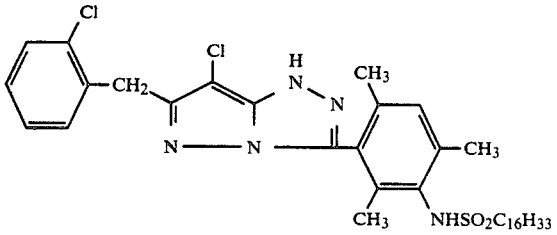
M-42
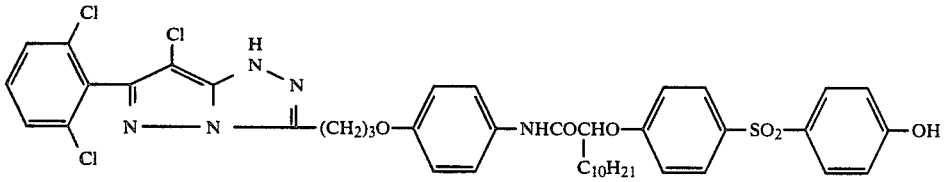
M-43
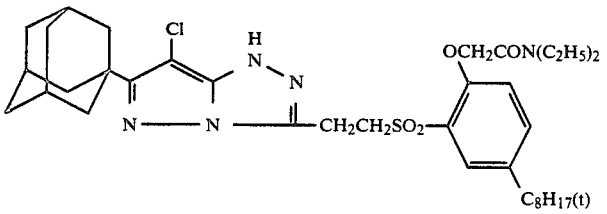
M-44
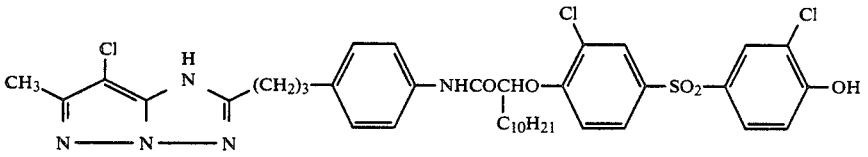
M-45
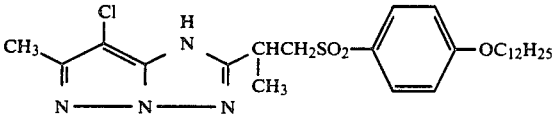
M-46
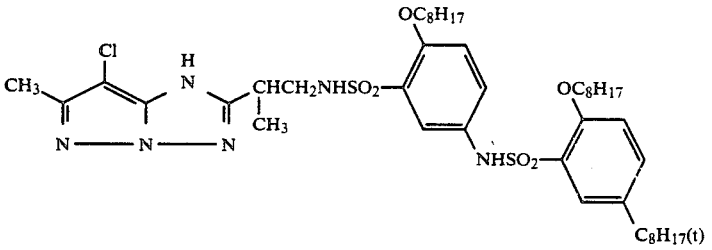
M-47
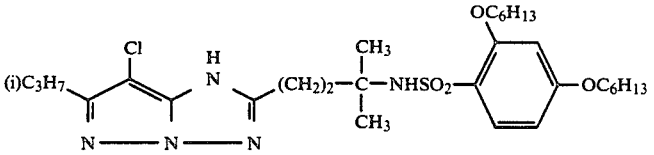

-continued
M-48
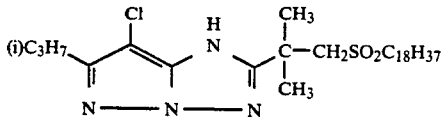
M-49
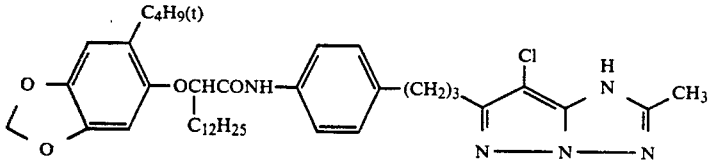
M-50
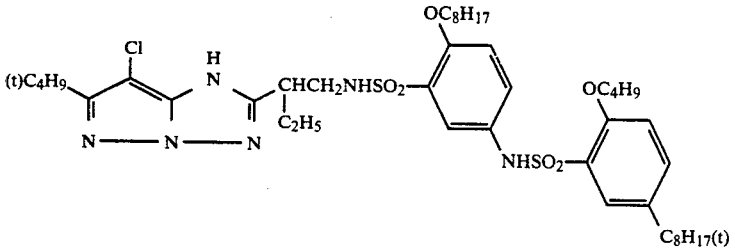
M-51
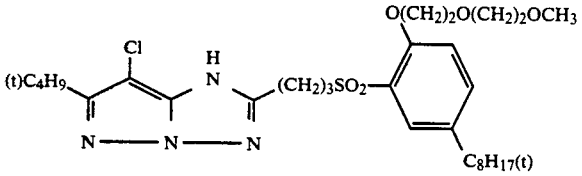
M-52
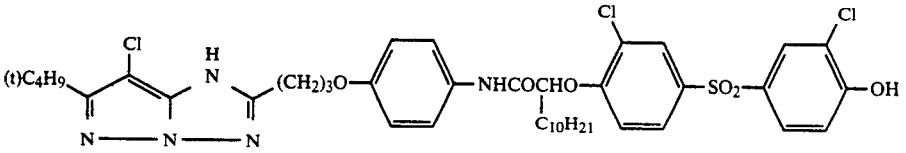
M-53
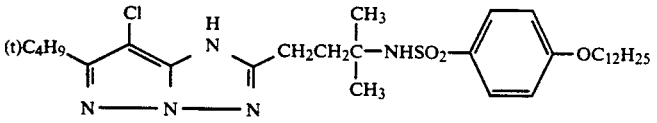
M-54
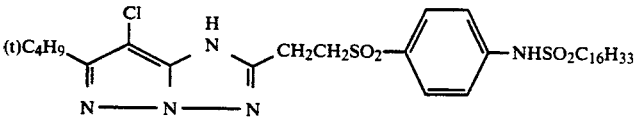
M-55
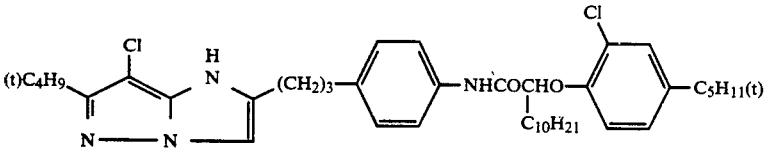
M-56
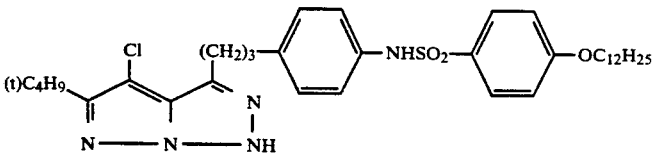

-continued

M-57

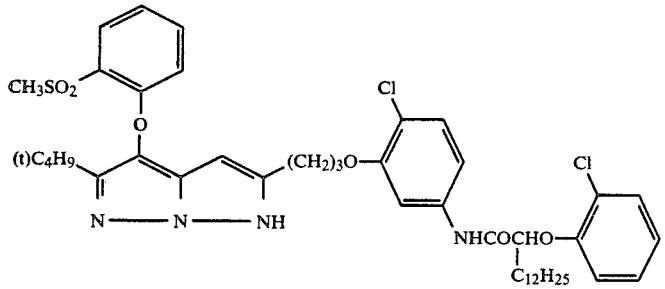

M-58

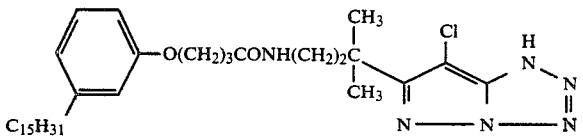

M-59

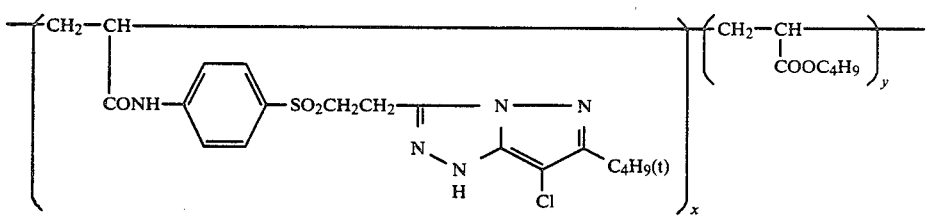

x:y = 50:50 (Weight ratio)

M-60

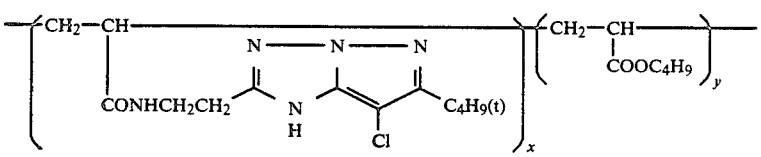

x:y = 50:50 (Weight ratio)

M-61

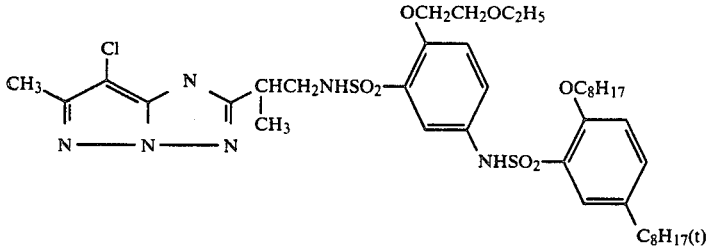

In addition to the typical examples given above, the examples of the compounds according to the invention are those shown by Nos. 1 through 4, 6, 8 through 17, 19 through 24, 26 through 43, 45 through 59, 61 through 104, 106 through 121, 123 through 162, 164 through 223 described in pp. 18–32 of the specification of Japanese Patent O.P.I. Publication No. 166339/1987.

These couplers can be synthesized by referring to the Journal of the Chemical Society, Perkin I (1977), pp. 2047–2052; U.S. Pat. No. 3,725,067, Japanese Patent O.P.I. Publication Nos. 99437/1984, 42045/1983, 162548/1984, 171956/1984, 33552/1985, 43659/1985, 172982/1985 and 190779/1985.

The couplers of the invention are usually used in an amount of $1\times10^{-3}$ mol to 1 mol, or, preferably, $1\times10^{-2}$ mol to $8\times10^{-1}$ mol, per mol silver halide.

Further, the couplers of the invention can be used in conjunction with other types of magenta couplers.

Examples of the compounds represented by General Formula [II] are described below.

The secondary or tertiary alkyl group, or, secondary or tertiary alkenyl group represented by $R^1$ is preferably one having 3 to 32, in particular, 4 to 12 carbon atoms, and typical examples of which include t-butyl, s-butyl, t-amyl, s-amyl, t-octyl, i-propyl, i-propenyl and 2-hexenyl groups.

The alkyl group represented by $R^2$is preferably one having 1 to 32 carbon atoms, while the alkenyl group so-represented is preferably one having 2 to 32 carbon atoms; and both of the alkyl and alkenyl groups may have a substituent and may be straight-chained or branched. Typical examples of these groups include methyl, ethyl, t-butyl, pentadecyl, 1-hexynonyl, 2-chlorobutyl, benzyl, 2,4-di-t-amylphenoxymethyl, 1-ethoxytridecyl, allyl and iso-propenyl groups.

The cycloalkyl group represented by $R^1$ and $R^2$is preferably one having 3 to 12 carbon atoms, and examples of which include cyclohexyl, 1-methylcyclohexyl and cyclopentyl groups.

The aryl group represented by $R^1$ and $R^2$is preferably phenyl or naphthyl group, and may have a substituent, and typical examples of which include phenyl, 4-nitrophenyl, 4-t-butylphenyl, 2,4-di-t-amylphenyl, 3-hexadecyloxyphenyl and e-naphthyl groups. The alkylene group represented by Y is preferably one having 1 to 12 carbon atoms, and may have a substituent, and typical examples of which include methylene, ethylene, propylene, butylidene and hexamethylene groups. Examples of the substituents which $R^1$, $R^2$and Y may have include a halogen atom, and nitro, cyano, amido, sulfonamide, alkoxy, aryloxy, alkylthio, arylthio and acyl groups.

For the compounds represented by General Formula [II], the preferable structure is shown by the General Formula [II-1].

General Formula [II-1]

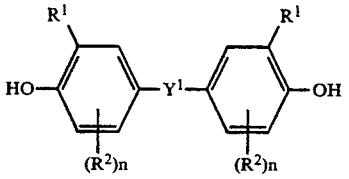

wherein $R^1$, $R^2$ and n are synonymous with those of General Formula [II]; $Y^1$ represents —S— or

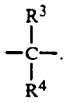

$R^3$ and $R^4$ individually represent a hydrogen atom, alkyl (e.g. methyl, ethyl, i-propyl, hexyl or benzyl) or alkenyl (e.g. allyl, i-propyl or 1-ethyl-1-pentyl). n is preferably 0 or 1. When n is 1, $R^2$is preferably primary or secondary alkyl group. In particular, $Y^1$ is

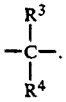

The following are typical examples of General Formula [II] according to the invention, wherein the scope of the invention is not limited only to these compounds.

II-1

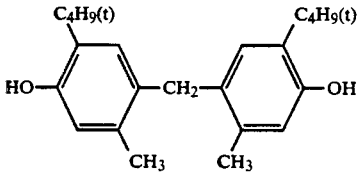

-continued

II-2

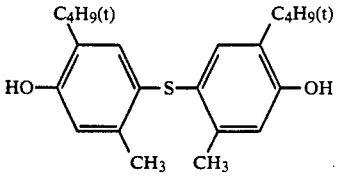

II-3

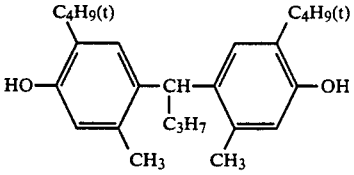

II-4

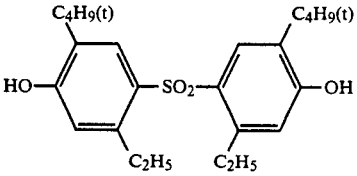

II-5

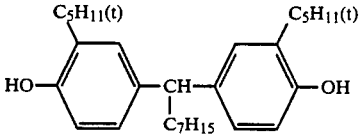

II-6

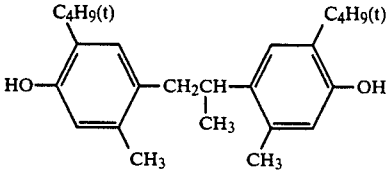

II-7

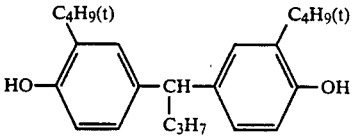

II-8

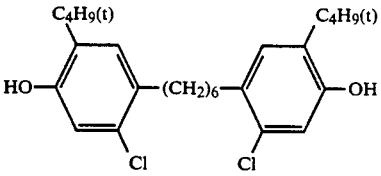

II-9

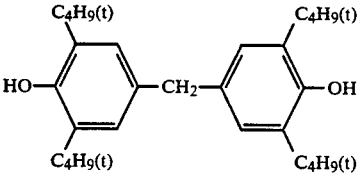

II-10

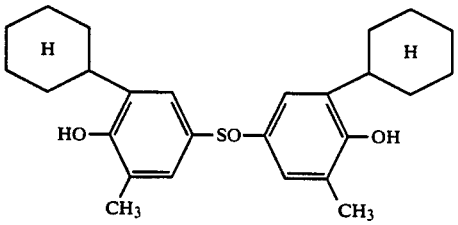

-continued
II-11
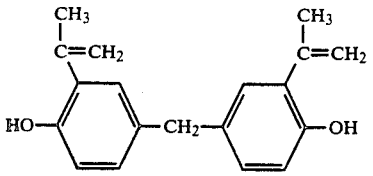
II-12
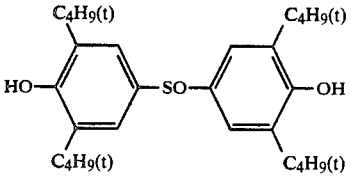
II-13
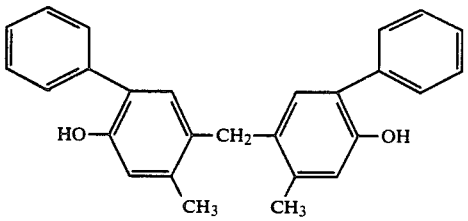
II-14
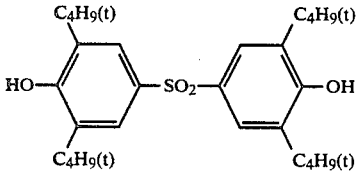
II-15
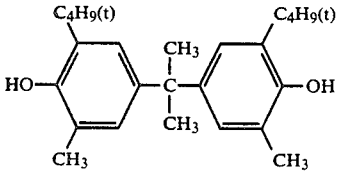
II-16
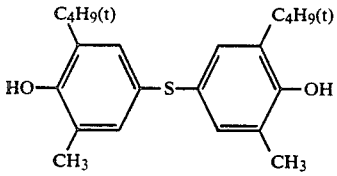
II-17
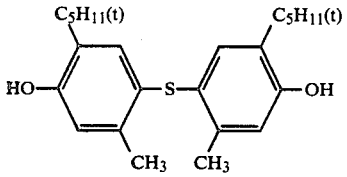
II-18
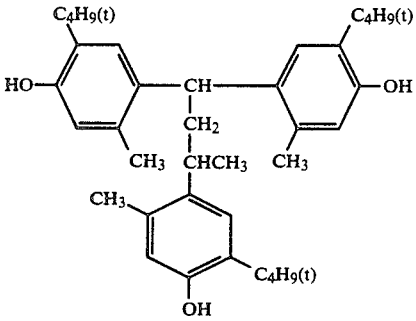
-continued
II-19
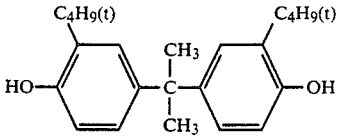
II-20
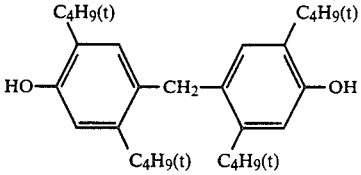
II-21
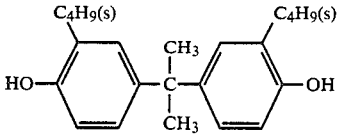
II-22
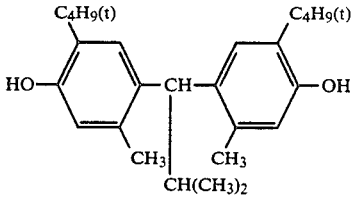
II-23
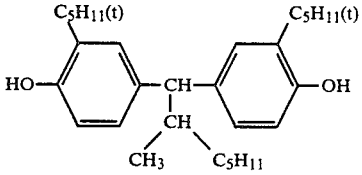
II-24
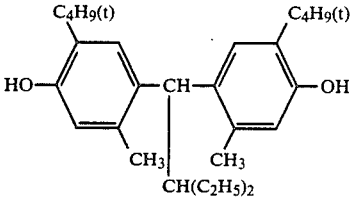
II-25
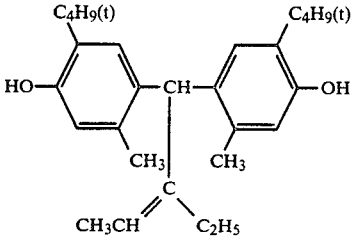
II-26
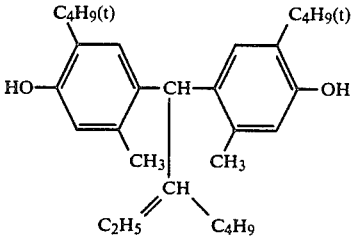

-continued

II-27

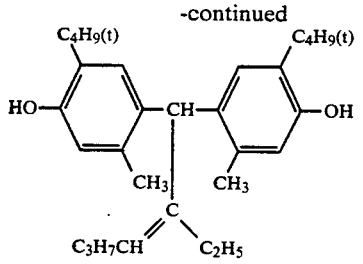

II-28

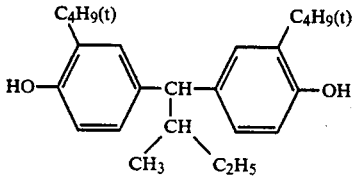

II-29

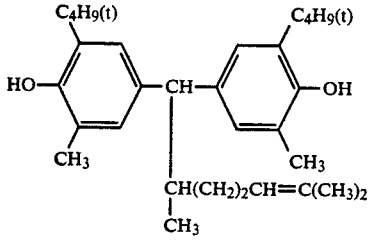

II-30

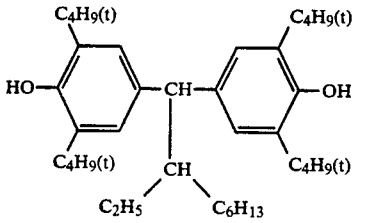

II-31

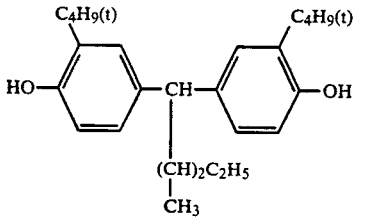

II-32

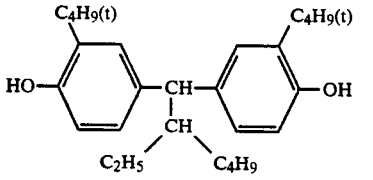

II-33

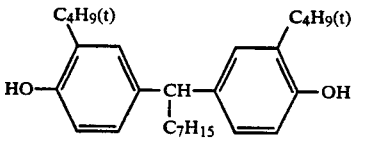

The compounds that are represented by General Formula [II] can be synthesized in a manner described in U.S. Pat. No. 2,807,653 and Journal of the Chemical Society, Perkin I pp. 1712 (1979), etc.

The compounds represented by General Formula [II] according to the invention are preferably incorporated into a color photographic material, in particular, into an organic coloring material, a layer where it is formed, or a layer adjacent to this layer.

The compounds represented by the formula II are used in the amount of 1–500 mol% of the compound represented by the general formula M-1. They are used preferably 2-300 mol% and more preferably 50–200 mol% of the compound represented by formula M-1.

The compounds of the invention can be effectively dispersed by the same method that is used for dispersing couplers.

The compounds of the invention are oil-soluble in general. Therefore, it is preferable to disperse them, according to the method described in U.S. Pat. Nos. 2,322,027, 2,801,170, 2,801,171, 2,272,191 and 2,304,940, in a high boiling solvent, or dissolve using a low boiling solvent in conjunction according to a specific requirement, and then added to a hydrophilic colloidal solution. Couplers, hydroquinone derivatives, ultraviolet absorbents, or publicly known anti-fading agents may be added at need. Examples of publicly known anti-fading agents, for instance, are seen in Japanese Patent O.P.I. publication No. 143754/1986, etc. At that time, two or more of the compounds according to the invention may be incorporated.

The silver halide emulsion used in the light-sensitive photographic material of the invention is, in general, a hydrophilic colloid in which silver halide particles are dispersed, wherein the silver halide is silver chloride, silver bromide, silver iodide, silver chlorobromide, silver iodobromide or silver chloro-iodo-bromide, or a mixture thereof.

EXAMPLES

The present invention is hereunder described in more detail referring to the following examples. However, these examples by no means limit the scope of the invention.

EXAMPLE 1

Onto a paper support coated with polyethylene on both sides were formed the following layers one by one to prepare a silver halide light-sensitive multicolor photographic material, thus Sample No. 1 was obtained.

First Layer: Blue-Sensitive Silver Halide Emulsion Layer

The layer was formed so as to make coating weight of α-pivaloyl-α-(2,4-dioxo-1-benzylimidazolidine-3-yl)-2-chloro-5-[γ-(2,4-di-t-amylphenoxy)-butylamide]acetoanilide as yellow coupler being 6.8 mg/100 $cm^2$; blue-sensitive silver chlorobromide emulsion (containing 85 mol% of silver bromide) 3.2 mg/100 $cm^2$ (as converted to silver), dibutyl phthalate 3.5 mg/100 $cm^2$ and gelatin 13.5 mg/100 $cm^2$.

Second Layer: Intermediate Layer

The layer was formed so as to make coating weight of 2,5-di-t-octyl hydroquinone 0.5 mg/100 $cm^2$, dibutyl phthalate 0.5 mg/100 $cm^2$ and gelatin 9.0 mg/100 $cm^2$.

Third Layer: Green-Sensitive Silver Halide Emulsion Layer

The layer was formed so as to make coating weight of magenta coupler (A) 3.5 mg/100 $cm^2$, green-sensitive silver chlorobromide emulsion (containing 80 mol% of silver bromide) 2.5 mg/100 $cm^2$ (as converted to silver), dibutyl phthalate 3.0 mg/100 $cm^2$ and gelatin 12.0 mg/100 $cm^2$.

Fourth Layer: Intermediate Layer

The layer was formed so as to make coating weight of 2-(2-hydroxy-3,5-di-t-butylphenyl)benzotriazole as UV absorbent 0.7 mg/100 $cm^2$, dibutyl phthalate 6.0 mg/100 $cm^2$, 2,5-di-t-octyl hydroquinone 0.5 mg/100 $cm^2$ and gelatin 12.0 mg/100 $cm^2$.

Fifth Layer: Red-Sensitive Silver Halide Emulsion Layer

The layer was formed so as to make coating weight of 2-[α-(2,4-di-t-pentylphenoxy)butane amide]-4,6-dichloro- 5-ethylphenol as cyan coupler 4.2 mg/100 $cm^2$, red-sensitive silver chlorobromide emulsion (containing 80 mol% of silver bromide) 3.0 mg/100 $cm^2$ (as converted to silver), tricresyl phosphate 3.5 mg/100 $cm^2$ and gelatin 11.5 mg/100 $cm^2$.

Sixth Layer: Protective Layer

Gelatin layer was formed so as to make a coating weight of 8.0 mg/100 $cm^2$.

Separately, Sample Nos. 2 through 33 were prepared in a manner identical to that of the above, except that the combination of the magenta coupler and the dye-image stabilizer in the third layer was changed as seen in Table 1. The dye-image stabilizer was added in an amount of 100 mol% relative to coupler.

The so-prepared samples were exposed through an optical wedge according to a conventional method, and then subjected to the following treatments:

| Process | Temperature | Time |
|---|---|---|
| Color Developing | 33° C. | 3 min. 30 sec. |
| Bleach-fixing | 33° C. | 1 min. 30 sec. |
| Washing | 33° C. | 3 min. |
| Drying | 50–80° C. | 2 min. |

Composition of these treating baths were as follows:

| [Color Developer] | |
|---|---|
| Benzyl alcohol | 12 ml |
| Diethylene glycol | 10 ml |
| Potassium carbonate | 25 g |
| Sodium bromide | 0.6 g |
| Sodium sulfite anhydride | 2.0 g |
| Hydroxylamine sulfate | 2.5 g |
| N-ethyl-N-β-methane sulfonamide ethyl-3-methyl-4-aminoaniline sulfate | 4.5 g |

Water was added to 1l, and the pH was adjusted to 10.2 with sodium hydroxide.

| [Bleach-fixer] | |
|---|---|
| Ammonium thiosulfate | 120 g |
| Sodium metabisulfite | 15 g |
| Sodium sulfite anhydride | 3 g |
| Ferric (III) ammonium ethylenediamine tetraacetate | 65 g |

Water was added to 1l, and the pH was adjusted to 6.7 to 6.8.

The density of each so-processed sample was measured using the densitometer, Model KD-7R (Konica Corporation), under the following conditions.

Each sample was exposed for 16 days in a xenon fadeometer, and then, tested for light fastness of the dye image at density 1.0 and increase of blue density on the non-colored portion (Y-stain).

Table 1 shows the test results.

Two evaluation items, namely residual rate (%) of the 1.0 magenta dye density portion and increase of blue density on the non-colored portion (Y-stain), were taken as the light fastness of the samples after xenon illumination.

Comparison Coupler A

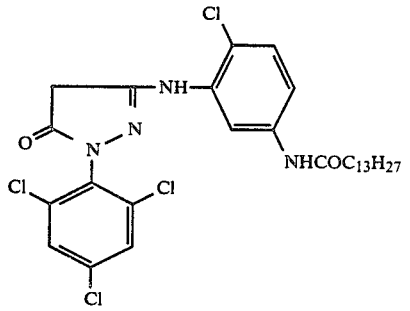

AO-1

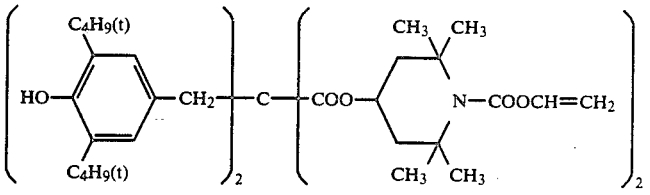

AO-2

-continued

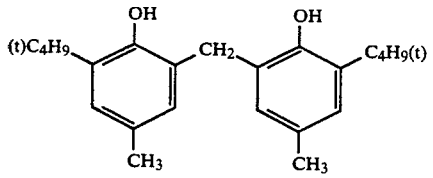

Comparison Coupler B

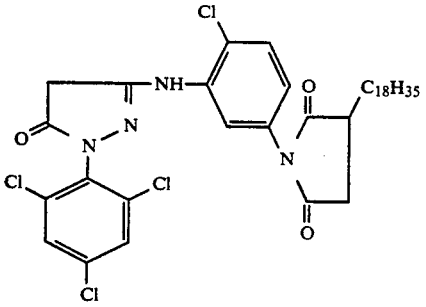

TABLE 1

| Sample No. | Magenta Coupler | Color Image Stabilizer | Light Fastness Residual Rate (%) | Light Fastness Y-stain |
|---|---|---|---|---|
| 1 (Comparison) | Comparison A | — | 22 | 0.60 |
| 2 (Comparison) | Comparison A | AO-1 | 53 | 0.65 |
| 3 (Comparison) | Comparison A | AO-2 | 54 | 0.66 |
| 4 (Comparison) | Comparison A | II-2 | 50 | 0.65 |
| 5 (Comparison) | Comparison A | II-3 | 48 | 0.65 |
| 6 (Comparison) | Comparison A | II-12 | 47 | 0.64 |
| 7 (Comparison) | Comparison A | II-14 | 48 | 0.65 |
| 8 (Comparison) | Comparison A | II-16 | 49 | 0.66 |
| 9 (Comparison) | Comparison A | II-26 | 50 | 0.65 |
| 10 (Comparison) | Comparison A | II-27 | 48 | 0.65 |
| 11 (Comparison) | Comparison A | II-32 | 47 | 0.66 |
| 12 (Comparison) | M-10 | — | 24 | 0.05 |
| 13 (Comparison) | M-10 | AO-1 | 54 | 0.11 |
| 14 (Comparison) | M-10 | AO-2 | 55 | 0.12 |
| 15 (Invention) | M-10 | II-2 | 67 | 0.06 |
| 16 (Invention) | M-10 | II-3 | 69 | 0.06 |
| 17 (Invention) | M-10 | II-12 | 61 | 0.07 |
| 18 (Invention) | M-10 | II-14 | 62 | 0.08 |
| 19 (Invention) | M-10 | II-16 | 66 | 0.07 |
| 20 (Invention) | M-10 | II-26 | 68 | 0.05 |
| 21 (Invention) | M-10 | II-27 | 65 | 0.07 |
| 22 (Invention) | M-10 | II-32 | 67 | 0.05 |
| 23 (Comparison) | M-46 | — | 22 | 0.06 |
| 24 (Comparison) | M-46 | AO-1 | 53 | 0.12 |
| 25 (Comparison) | M-46 | AO-2 | 54 | 0.11 |
| 26 (Invention) | M-46 | II-2 | 65 | 0.07 |
| 27 (Invention) | M-46 | II-3 | 67 | 0.07 |
| 28 (Invention) | M-46 | II-12 | 60 | 0.07 |
| 29 (Invention) | M-46 | II-14 | 60 | 0.08 |
| 30 (Invention) | M-46 | II-16 | 64 | 0.08 |
| 31 (Invention) | M-46 | II-26 | 66 | 0.08 |
| 32 (Invention) | M-46 | II-27 | 64 | 0.06 |
| 33 (Invention) | M-46 | II-32 | 63 | 0.07 |

It is understood from the result shown in Table 1 that the compounds of the invention effectively stabilize the magenta dye image formed from magenta coupler, and effectively inhibit the Y-stain on the non-colored portion.

EXAMPLE 2

Sample Nos. 34 through 66 were prepared in a manner identical to that used to prepare Sample No. 1 in Example 1, except that a silver chlorobromide emulsion (99.5 mol% silver chloride) was employed instead of the various silver halide emulsions, and in the third layer, use of the magenta coupler and the dye image stabilizer was changed as shown in Table 2.

Sample Nos. 34 through 66 were exposed through an optical wedge in a conventional method, and then subjected to the following processes.

| Process | Temperature | Time |
|---|---|---|
| Color Development | 34.7 ± 0.3° C. | 45 sec. |
| Bleach-fixing | 34.7 ± 0.5° C. | 45 sec. |
| Stabilization | 30–34° C. | 90 sec. |
| Drying | 60–80° C. | 60 sec. |

| [Color Developer] | |
|---|---|
| Pure water | 800 ml |
| Triethanolamine | 8 g |
| N,N,-diethyl hydroxylamine | 5 g |
| Potassium chloride | 2 g |
| N-ethyl-N-β-methane sulfonamide ethyl-3-methyl-4-aminoaniline sulfate | 5 g |
| Sodium tetrapolyphosphate | 2 g |
| Potassium carbonate | 30 g |
| Potassium sulfite | 0.2 g |
| Fluorescent whitening agent (4,4'-diaminostilbene disulfonic acid derivative) | 1.0 g |

Pure water was added to 1l, and the pH was adjusted to 10.2.

| [Bleach-fixer] | |
|---|---|
| Ferric (III) ammonium ethylenediamine tetraacetate dihydrate | 60 g |
| Ethylenediamine tetraacetic acid | 3 g |
| Ammonium thiosulfate (70% aqueous solution) | 100 ml |
| Ammonium sulfite (40% aqueous solution) | 27.5 ml |

Water was added to 1l, and the pH was adjusted to 5.7 using potassium carbonate or glacial acetic acid.

| [Stabilizing Bath] | |
|---|---|
| 5-chloro-2-methyl-4-isothiazoline-3-one | 1 g |
| 1-hydroxyethylidene-1,1-diphosphonic acid | 2 g |

Water was added to 1l, and the pH was adjusted to 7.0 using sulfuric acid or potassium hydroxide.

Each so-treated sample was tested for light fastness (image dye residual rate and Y-stain) in the same manner that is used in Example 1. Table 2 shows the results.

TABLE 2

| Sample No. | Magenta Coupler | Color Image Stabilizer | Light Fastness Residual Rate (%) | Light Fastness Y-stain |
|---|---|---|---|---|
| 34 (Comparison) | Comparison-B | — | 23 | 0.59 |
| 35 (Comparison) | Comparison-B | AO-1 | 54 | 0.64 |
| 36 (Comparison) | Comparison-B | AO-2 | 53 | 0.65 |
| 37 (Comparison) | Comparison-B | II-3 | 51 | 0.64 |
| 38 (Comparison) | Comparison-B | II-9 | 50 | 0.65 |
| 39 (Comparison) | Comparison-B | II-15 | 49 | 0.63 |
| 40 (Comparison) | Comparison-B | II-18 | 48 | 0.64 |
| 41 (Comparison) | Comparison-B | II-19 | 49 | 0.65 |
| 42 (Comparison) | Comparison-B | II-23 | 49 | 0.63 |
| 43 (Comparison) | Comparison-B | II-26 | 52 | 0.65 |
| 44 (Comparison) | Comparison-B | II-29 | 48 | 0.64 |
| 45 (Comparison) | M-4 | — | 22 | 0.05 |
| 46 (Comparison) | M-4 | AO-1 | 55 | 0.11 |
| 47 (Comparison) | M-4 | AO-2 | 56 | 0.12 |
| 48 (Invention) | M-4 | II-3 | 67 | 0.06 |
| 49 (Invention) | M-4 | II-9 | 60 | 0.07 |
| 50 (Invention) | M-4 | II-15 | 65 | 0.07 |
| 51 (Invention) | M-4 | II-18 | 66 | 0.06 |
| 52 (Invention) | M-4 | II-19 | 66 | 0.06 |
| 53 (Invention) | M-4 | II-23 | 64 | 0.06 |
| 54 (Invention) | M-4 | II-26 | 69 | 0.06 |
| 55 (Invention) | M-4 | II-29 | 65 | 0.06 |
| 56 (Comparison) | M-23 | — | 25 | 0.05 |
| 57 (Comparison) | M-23 | AO-1 | 57 | 0.12 |
| 58 (Comparison) | M-23 | AO-2 | 58 | 0.11 |
| 59 (Invention) | M-23 | II-3 | 71 | 0.06 |
| 60 (Invention) | M-23 | II-9 | 64 | 0.07 |
| 61 (Invention) | M-23 | II-15 | 69 | 0.07 |
| 62 (Invention) | M-23 | II-18 | 70 | 0.06 |
| 63 (Invention) | M-23 | II-19 | 70 | 0.06 |
| 64 (Invention) | M-23 | II-23 | 68 | 0.06 |
| 65 (Invention) | M-23 | II-26 | 73 | 0.07 |
| 66 (Invention) | M-23 | II-29 | 66 | 0.07 |

As evidently shown by Table 2, the samples containing the compounds according to the invention are capable of forming images that have excellent light stability and lower tendency to cause Y-stain and color fading.

What is claimed is:

1. A silver halide light-sensitive photographic material comprising a support and provided thereon at least one silver halide emulsion layer, which material contains a compound represented by formula M-1 and at least one compound represented by formula II;

M-I

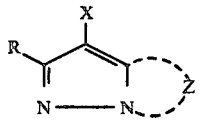

wherein Z is a nonmetallic atomic group necessary for forming a nitrogen-containing heterocyclic ring, wherein so-formed ring may have a substituent; X is a hydrogen, halogen atom, or a group that is capable of being split off by reaction with an oxidation product of a color developing agent; R is a hydrogen atom or a substituent;

II

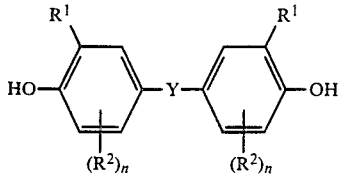

wherein $R^1$ is a secondary or tertiary alkyl group, a secondary or tertiary alkenyl group, a cycloalkyl or an aryl group, $R^2$ is a halogen atom, an alkyl, alkenyl, cycloalkyl or aryl group, n is an integer of 0 to 3, Y is a S, SO,$SO_2$ or alkylene group.

2. The material of claim 1 wherein the R shown in the formula M-I represents a hydrogen atom, an alkyl group, aryl group, anilino group, acylamino group, sulphonamide group, alkylthio group, arylthio group, alkenyl group or cycloalkyl group.

3. The material of claim 2 wherein the R shown in the general formula M-I represents an alkyl group having 1 to 32 carbon atoms which is straight or branched.

4. The material of claim 1 wherein the X shown in the formula M-I represents a hydrogen atom, halogen atom, an alkoxy, aryloxy heterocyclicoxy, acyloxy, sulphonyloxy, alkoxycarbonyloxy, aryloxycarbonyl, alkyloxalyloxy, alkoxyoxalyloxy, alkylthio, arylthio, heterocyclicthio, alkyloxythiocarbonylthio, acylamino, sulphonamide, N atombonded nitrogen-containing heterocyclic, alkyloxycarbonylamino, aryloxycarbonylamino, carboxyl or

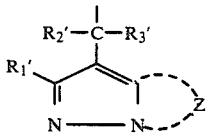

wherein $R_1'$ is synonymous with the R shown in the formula M-I, Z' is synonymous with the Z shown in the formula M-I, $R_2'$ and $R_3'$ independently represent a hydrogen atom, an aryl, alkyl or heterocyclic group.

5. The material of claim 4 wherein X is a hydrogen atom or halogen atom.

6. The material of claim 5 wherein X is a hydrogen atom or a chlorine atom.

7. The material of claim 1 wherein the nitrogen containing heterocycle formed by Z is a pyrazole, imidazole, triazole or tetrazole ring, which may have substituent selected from the group consisting of a hydrogen atom, an alkyl, aryl, anilino, acylamino, sulphonamido, alkylthio, alkenyl or cycloalkyl group.

8. The material of claim 1 wherein the formula M-I is represented by formula M-VIII,

M-VIII

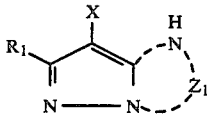

wherein $R_1$, X and $Z_1$ are synonymous with R, X and Z shown in the formula M-I.

9. The material of claim 1 wherein the formula M-I is represented by a formula-selected from the group consisting of formula M-II, M-III, M-IV, M-V, M-VI and M-VII;

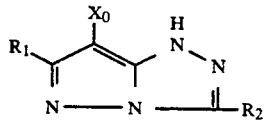
(M-II)

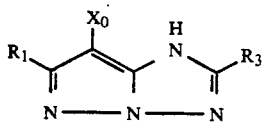
(M-III)

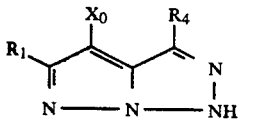
(M-IV)

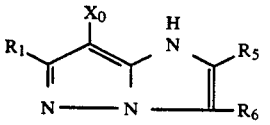
(M-V)

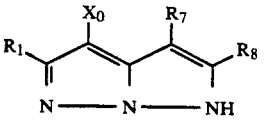
(M-VI)

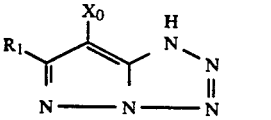
(M-VII)

wherein $X_0$ and $R_1$ through $R_8$ are synonymous with the X and the R shown in the formula M-I.

10. The material of claim 9 wherein the formula M-I is represented by formula M-II.

11. The material of claim 3 wherein R shown in the formula M-I is represented by formula M-IX,

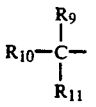
M-IX wherein $R_9$, $R_{10}$ or $R_{11}$ is a hydrogen atom, an alkyl group, aryl group, anilino group, acylamino group, sulfonamide group, alkylthio group, arylthio group, alkenyl group or cycloalkyl group.

12. The material of claim 11 wherein at least two of $R_9$ through $R_{11}$ are alkyl groups.

13. The material of claim 12 wherein two of $R_9$ through $R_{11}$ are alkyl groups and one of $R_9$ through $R_{11}$ is a hydrogen atom or an alkyl group.

14. The material of claim 11 wherein one of $R_9$ through $R_{11}$ is a hydrogen atom and two of $R_9$ through $R_{11}$ bond each other to form a cycloalkyl group.

15. The material of claim 1, claim 8 or claim 9, wherein at least one of the substituent which linked with the ring formed by Z of formula M-I or with the ring formed by Z of formula M-III or the $R^2$ through $R^8$ of formula M-II through M-VI, is represented by formula M-X ;

$$-R_{12}-SO_2-R_{13} \qquad \text{M-X}$$

wherein $R_{12}$ is an alkylene group; and $R_{13}$ is an alkyl, cyclo alkyl or aryl group.

16. The material of claim 15 wherein $R_{12}$ is an alkylene group having at least two carbon atoms in the straight-chain portion and is straight-chained or branched.

17. The material of claim 15 wherein $R_{12}$ is an alkylene group having 3 to 6 carbon atoms in the straight-chain portion and is straight-chained or branched.

18. The material of claim 15 wherein the cycloalkyl group represented by $R_{13}$ is 5- to 6-membered.

19. The material of claim 1, wherein the compound represented by formula M-I is used in an amount of $1\times10^{-3}$ mol to 1 mol per mol of silver halide.

20. The material of claim 19 wherein the compound is used in an amount of $1\times10^{-2}$ mol to $8\times10^{-1}$ mol per mol of silver halide.

21. The material of claim 1 wherein the secondary or tertiary alkyl group, or, secondary or tertiary alkenyl group represented by $R^1$ shown in the formula II comprises 3 to 32 carbon atoms.

22. The material of claim 21 wherein $R^1$ comprises 4 to 12 carbon atoms.

23. The material of claim 22 wherein $R^1$ is a t-butyl, s-butyl, t-amyl, s-amyl, t-octyl, i-propyl, i-propenyl, or 2-hexenyl group.

24. The material of claim 1 wherein the alkyl group represented by $R^2$ comprises 1 to 32 carbon atoms, the alkenyl group represented by $R^2$ comprises 2 to 32 carbon atoms; and both of the alkyl or alkenyl group may have a substituent and may be straight-chained or branched.

25. The material of claim 24 wherein $R^2$ is a methyl, ethyl, t-butyl, pentadecyl, 1-hexynonyl, 2-chlorobutyl, benzyl, 2,4-di-t-amylphenoxymethyl, 1-ethoxytridecyl, allyl or iso-propenyl group.

26. The material of claim 1 wherein the alkylene group represented by Y shown in the formula II comprises 1 to 12 carbon atoms.

27. The material of claim 26 wherein Y is a methylene, ethylene, propylene, butylidene or hexamethylene group which may have a substituent.

28. The material of claim 1 wherein formula 11 is represented by formula II-I;

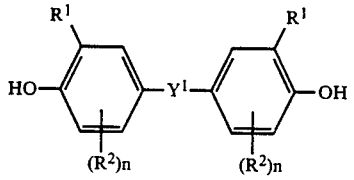
II-I wherein $R^1$,$R^2$ and n are synonymous with those of general formula II; $Y^1$ represents —S— or

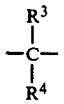

$R^3$ and $R^4$ individually represent a hydrogen atom, an alkyl, or alkenyl group.

29. The material of claim 28 wherein n is an integer of 0 or 1.

30. The material of claim 28 wherein , n is 1, and $R^2$ is a primary or secondary alkyl group.

31. The material of claim 28 wherein n is 1 and $R^2$ is a primary or secondary alkyl group, $Y^1$ is

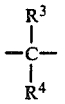

32. The material of claim 1 wherein the silver halide emulsion layer comprises the compound represented by the formula M-I.

33. The material of claim 1 wherein the compound of formula M-I is contained in the same layer with or the adjacent layer to the layer contains the compound of formula II.

34. The material of claim 32, comprising the compound represented by formula II in an amount of 1–500 mol % of the compound represented by formula M-I.

35. The material of claim 33, comprising the compound represented by formula II in an amount of 2–300 mol % of the compound represented by formula M-I.

36. The material of claim 34, comprising the compound represented by formula II in an amount of 50–200 mol % of the compound represented by formula M-I.

* * * * *